United States Patent [19]

Bishop

[11] Patent Number: 4,695,526

[45] Date of Patent: Sep. 22, 1987

[54] POLY(ETHYLENE OXIDE) STRIPPING AGENTS FOR PHOTOGRAPHIC PRODUCTS

[75] Inventor: John F. Bishop, Rochester, N.Y.

[73] Assignee: Eastman Kodak Company, Rochester, N.Y.

[21] Appl. No.: 884,346

[22] Filed: Jul. 11, 1986

[51] Int. Cl.[4] ..... G03C 5/54; G03C 1/90

[52] U.S. Cl. ..... 430/215; 430/227; 430/236; 430/244; 430/262

[58] Field of Search ..... 430/215, 227, 262, 236, 430/244

[56] References Cited

U.S. PATENT DOCUMENTS

| | | | |
|---|---|---|---|
| 3,591,411 | 7/1971 | Faulhaber | 34/9 |
| 3,793,023 | 2/1974 | Land | 430/212 |
| 4,459,346 | 7/1984 | Bishop et al. | 430/215 |

*Primary Examiner*—Richard L. Schilling
*Attorney, Agent, or Firm*—Thomas F. Kirchoff

[57] ABSTRACT

High molecular weight polymeric poly(ethylene oxide) compounds are employed as stripping agents for separating layers of photographic products.

11 Claims, No Drawings

POLY(ETHYLENE OXIDE) STRIPPING AGENTS FOR PHOTOGRAPHIC PRODUCTS

This invention relates to photography, and in particular to the use of certain poly(ethylene oxide) compounds as stripping agents for separating contiguous gelatin-based layers of photographic products. This invention is particularly useful in photographic products which require separation of layers in order to recover a processed image record.

Various formats for color, integral transfer elements are described in U.S. Pat. Nos. 3,415,644; 3,415,645; 3,415,646; 3,647;437; 3,635,707; 3,756,815, and in Canadian Pat. Nos. 928,559 and 674,082. In these formats the image-receiving layer, which contains the photographic image for viewing, remains permanently attached and integral with the image-generating units and ancillary layers present in the structure when a transparent support is employed on the viewing side of an assemblage. An image is formed by dyes, produced in the image-generating units, which diffuse through the layers of the assemblage to a dye image-receiving layer. After exposure of the assemblage, an alkaline processing composition is caused to permeate the various layers in order to initiate development of the exposed photosensitive silver halide emulsion layers. The emulsion layers are developed in proportion to the extent of the respective exposures. Image dyes, which are formed or released in the respective image-generating layers, begin to diffuse throughout the structure. At least a portion of an image-wise distribution of diffusible dyes diffuses to the dye image-receiving layer to form an image of the original subject.

A problem with integral assemblages as described above is that the silver halide and other imaging layers, the spent pod which originally contained processing composition, and a trap which retains excess processing fluid all remain with the desired print after processing. The resulting prints are bulky and are difficult to stock or store in albums.

Various formats for peel-apart diffusion transfer photographic products are also known. These have previously been described in U.S. Pat. Nos. 2,983,606; 3,362,819 and 3,362,821. In these formats, the image-receiving element must be separated from the photosensitive element after a certain time has elapsed, usually about one minute. This need for separation raises several requirements. For example, the customer must time the development process which is a disadvantage if a timing device is not available. The portion of the assemblage to be discarded is wet with caustic processing fluid and care must be taken with its handling. Also, stripping layers are frequently employed to facilitate removal of unwanted parts and layers from the image portion.

There are various requirements for stripping layers, particularly those used in a diffusion transfer assemblage. The stripping layer must be easily coatable and dye passing through it on the way to the mordant must not be hindered. The assemblage must maintain physical integrity during storage, during high pH processing, as well as during the time after the pH is lowered by the process control layers following the imaging procedure and before the intended separation time. Physical integrity of the assemblage must be maintained throughout normal handling and flexing. Spontaneous separation or delamination must not occur. A stripping layer must also function to provide easy and clean separation at a desired point in time after processing, and where appropriate, after image transfer has taken place.

Image transfer assemblages usually use masks or other fluid restricting devices and thus have "dry" areas plus areas wet by processing fluid adjacent to each other. Stripping is usually initiated at an edge in a dry area in order to avoid contact with highly alkaline processing fluid. This requires a relatively weak dry bond in order to have a point to initiate stripping. Stripping must then be continuous and without fracture as the separating action passes between the wet/dry interface.

If an assemblage is employed to obtain a transparency element with high magnification projection, there is an additional requirement to maintain sharpness. To accomplish this, the diffusion path must be as short as possible. This necessitates use of a stripping layer which is nonswelling and which is as thin as possible.

Various materials are described in the art as being suitable for use as stripping layers. However, experience has shown that many of these materials fall short of one or more of the essential properties needed in stripping layers.

The use of high molecular weight polymeric poly(ethylene oxide) compounds as drying or dessicating agents for photographic elements is known from U.S. Pat. No. 3,591,441. This patent describes drying elements comprising a layer of polymeric poly(ethylene oxide) compounds coated on a support. These elements are brought into intimate contact with a processed photographic element and diffusible fluids are rapidly removed therefrom. However, this patent contains no teaching regarding incorporation of a layer of high molecular weight polymeric poly(ethylene oxide) into a photographic product for use as a stripping layer. Also, this patent does not teach that such polymeric materials would be permeable to complex, highly bulky organic molecules, such as image-forming dyes, so as to allow these molecules to diffuse through the poly(ethylene oxide) layers.

U.S. Pat. No. 3,793,023 describes the use of particular poly(ethylene glycols) to laminate image-donor elements to image-receiver elements. These poly(ethylene glycols) have molecular weights between about 6,000 to 7,500 and are described as providing a constant bond strength between gelatinous layers of a multicolor photographic diffusion transfer film laminate. However, as shown below by comparative data, subsequent delamination intended to occur at an interface defined by a poly(ethylene glycol) layer can not be relied upon to produce satisfactory stripping.

Accordingly, it is desirable to provide a stripping layer which strips cleanly, which fails adhesively, which does not materially alter the surface properties at the stripping interface of contiguous gelatin-based layers, which has an acceptable swelling rate in alkaline environment and which does not cause loss of sharpness in transferred images.

These requirements are provided by a photographic product according to this invention which comprises:

(a) a photosensitive element comprising a support having thereon at least one photosensitive silver halide emulsion layer;

(b) an image-receiving layer; and (c) a stripping layer located between said photosensitive element and said image-receiving layer, wherein said stripping layer comprises a nonionic poly(ethylene oxide) homopolymeric compound having a weight average molecular weight of from about 200,000 to about 5,000,000 present in such concentration that said image-receiving layer can be cleanly separated, after processing, from the remaining layers of said product.

The term "weight average molecular weight" as employed herein, and as abbreviated to "molecular weight," with respect to the described nonionic poly(ethylene oxide) homopolymeric compounds is a well known term in the polymeric art and can be determined by the method described on pages 145–147 of PHYSICAL CHEMISTRY OF MACROMOLECULES, Charles Tanford, John Wiley & Sons, Inc. 1961, which disclosure is incorporated herein by reference.

Typical poly(ethylene oxide) compounds which can be used as stripping agents in this invention include those listed in the following Table:

TABLE 1

| Molecular Weight | Tradename |
|---|---|
| 200,000 | POLYOX ® WSR N-80 |
| 300,000 | POLYOX ® WSR N-750 |
| 400,000 | POLYOX ® WSR N-3000 |
| 600,000 | POLYOX ® WSR-205 |
| 900,000 | POLYOX ® WSR-1105 |
| 1,000,000 | POLYOX ® WSR N-12K |
| 2,000,000 | POLYOX ® WSR N-60K |
| 4,000,000 | POLYOX ® WSR-301 |
| 5,000,000 | POLYOX ® Coagulant |

® POLYOX is a registered trademark of the Union Carbide Corporation.

Information regarding physical and chemical properties of these poly(ethylene oxide) compounds is available in (1) the *HANDBOOK OF WATER-SOLUBLE GUMS AND RESINS,* R. L. Davidson, ed., McGraw Hill Publishing Company, New York 1980, pages 19-1 to 33, and (2) a brochure entitled "POLYOX" published by Union Carbide Corporation (© 1981), the disclosures of which are hereby incorporated by reference.

The poly(ethylene oxide), hereinafter "PEO", stripping agents employed in this invention are used in an amount which is effective to provide clean separation between adjacent layers of a photographic product. Separation is particularly effective between adjacent gelatin-containing layers and is such that substantially no gelatin from adjacent layers adheres to the image-receiving layer.

Good results can be obtained using PEO concentrations from as low as about 25 mg/m$^2$ to as much as about 1,000 mg/m$^2$ of stripping layer. At concentrations from about 25 mg/m$^2$ to about 400 mg/m$^2$, discrete layers are obtained which impart excellent stripping properties with minimum, if any, adverse effects on image sharpness.

As the concentration of the stripping layer increases above about 1000 mg/m$^2$, the sharpness of an underlying image can become distorted due to the increased thickness of the layer. Moreover, a tendency toward delamination may be observed as stripping layer thickness increases. A preferred concentration of PEO compound, to maximize beneficial results, is from about 75 to about 300 mg/m$^2$ of stripping layer.

The concentration of PEO selected for a particular stripping layer can be varied depending upon the molecular weight of the compound used. For example, as the molecular weight of a PEO compound decreases, approaching for example the 200,000 level, relatively larger amounts of the stripping agent can be used to assure obtaining desired results.

The converse is also true. For example, where PEO compounds are used which have relatively higher molecular weights, e.g., from 4,000,000 to 5,000,000, lower amounts can be employed.

As the molecular weight of the PEO compounds falls below 200,000 stripping becomes more difficult. This is evidenced by nonuniform or unclean separation between adjacent gelatinous layers. As the molecular weight of PEO compounds increases above about 4,000,000 stripping becomes progressively easier with peel forces necessary to separate layers bonded by the PEO agents decreasing to relatively lower levels. As PEO molecular weights exceed the 5,000,000 level a tendency toward spontaneous delamination is sometimes observed. This is believed to be caused by decreasing adhesive properties of the PEO compounds at this high molecular weight level. Preferred PEO compounds are those having molecular weights between about 200,000 and about 4,000,000.

This invention finds particular application in a diffusion transfer assemblage that involves removing silver halide and dye image-providing material layers from an assemblage. The desired reflection print is obtained without the bulkiness caused by silver halide and other layers as well as the spent pod and the trap. This invention also combines the handling and storage characteristics of conventional photographs with the convenience and benefits of instant photography. In addition, a transparency element which requires a transparent support and the removal of residual image dye, silver halide and opacifying layers can be more easily obtained with this invention. There is also provided the option of recovery of expensive silver halide and image providing materials from the discarded portion of the assemblage.

This invention is also useful in recovering a so-called "retained" image from dye image-forming materials remaining in the layers where they were originally coated following processing and diffusion of the principal dye image to an image-receiving layer. A process of this type is described in U.S. Pat. No. 4,485,165, the disclosure of which is hereby incorporated by reference.

A stripping layer of this invention also provides weak dry adhesion, unlike other known stripping layers which have strong dry adhesion. Strong dry adhesion makes it difficult to initiate separation and to obtain clean separation into and through a "wet" area.

The preferred location for the stripping layer is adjacent to a mordant or image-receiving layer. It can also be located in other positions in a photographic product, such as between pigmented gelatin vehicle layers.

A process for producing a photographic image according to this invention comprises:

(I) exposing a photographic product as described above;

(II) treating the exposed product with an alkaline processing composition in the presence of a silver halide developing agent to effect development of each exposed silver halide emulsion layer, whereby:

(a) an imagewise distribution of image-providing material is formed as a function of development of the silver halide emulsion layer;

(b) at least a portion of the imagewise distribution of the image-providing material diffuses to an image-receiving layer; and (III) separating the image-receiving layer from the remainder of the photographic product whereby the image-receiving layer will have substantially none of the remaining layers of the product adhering thereto.

A preferred process of this invention is one wherein the silver halide emulsion layer has associated therewith a dye image-providing material.

The photographic product of the above-described process can be treated with an alkaline processing composition to effect or initiate development in any manner. A preferred method for applying processing composition is by use of rupturable containers or pods which contain the composition such as disclosed in U.S. Pat. Nos. 2,543,181; 2,643,886; 2,653,732; 2,723,051; 3,056,491; 3,056,492 and 3,152,515 the disclosures of which are hereby incorporated by reference.

In a preferred embodiment the photographic product is an assemblage which comprises:

(a) a photosensitive element comprising a support having thereon at least one silver halide emulsion layer having associated therewith a dye image-providing material;

(b) a transparent cover sheet located over the layer outermost from the support of the photosensitive element;

(c) a dye image-receiving layer located either in the photosensitive element or on the transparent cover sheet; and (d) an alkaline processing composition and means containing same for discharge between the photosensitive element and the transparent cover sheet;

the improvement wherein the assemblage contains a stripping agent, as described above, located between said silver halide emulsion layer and said image-receiving layer.

The means containing the alkaline processing composition can be adapted to be positioned during processing of the assemblage so that a compressive force applied to the container by pressure-applying members, such as would be found in a camera designed for in-camera processing, will effect a discharge of the container's contents within the assemblage. In general, the processing composition employed in this invention contains the agent for development, although the composition could also be an alkaline solution where the developer is incorporated in the photographic element or in a cover sheet, in which case the alkaline solution serves to activate the incorporated developer.

The dye image-providing material useful in this invention is either positive-working or negative-working, and is either initially mobile or initially immobile in the photographic product during processing with an alkaline composition. Such compounds are well known to those skilled in the art and include compounds which will react with oxidized or unoxidized developing agent or electron transfer agent to release a dye.

A format for negative-receiver photographic elements in which the present invention is useful is disclosed in Canadian Pat. No. 928,559. In this embodiment, the support for the photographic element is transparent and is coated with the image-receiving layer, a substantially opaque, light-reflective layer, a stripping layer according to this invention and the photosensitive layer or layers. As a result of the stripping layer, located between the photosensitive silver halide layer or layers and the opaque light reflective layer, separation of the unneeded processing layers can easily be removed and discarded.

In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

A variety of silver halide developing agents are useful in this invention. Specific examples of developers or electron transfer agents (ETA's) include hydroquinone compounds, catechol compounds, and 3-pyrazolidinone compounds. A combination of different ETA's can also be employed. These ETA's are employed in the liquid processing composition or contained, at least in part, in any layer or layers of the photographic element or film assemblage to be activated by the alkaline processing composition, such as in the silver halide emulsion layers, the dye image-providing material layers, interlayers image-receiving layer, etc.

A film unit or assemblage of the present invention is also used to produce black-and-white silver images, such as medical and dental x-ray films.

In forming a black-and-white image, the exposed photosensitive silver halide is developed. In unexposed areas, a silver halide complexing agent dissolves the silver halide and transfers it, in complexed form, to an image-receiving layer. Silver precipitating nuclei in the image-receiving layer then cause the transferred silver halide complex to be reduced to silver, thereby forming an image pattern corresponding to the original. Details of such a process are well known and are described, for example, in U.S. Pat. Nos. 3,220,835 and 3,820,999, the disclosures of which are hereby incorporated by reference.

The silver halide emulsions useful in this invention, both negative-working and direct-positive ones, are well known to those skilled in the art and are described in Research Disclosure, Volume 176, December, 1978, Item 17643, pages 22 and 23, "Emulsion preparation and types", they are usually chemically and spectrally sensitized as described on page 23, "Chemical sensitization", and "Spectral sensitization and desensitization", of the above article, they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners" and pages 26 and 27, "Coating aids", of the above article; they and other layers in the photographic elements used in this invention usually contain plasticizers, vehicles and filter dyes described on page 27, "Plasticizers and lubricants", page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

Internal image silver halide emulsions useful in this invention are described more fully in the November, 1976 edition of Research Disclosure, pages 76 through 79, the disclosure of which is hereby incorporated by reference.

The various silver halide emulsion layers of a color film assembly employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

Scavenger's for oxidized developing agent can be employed in various interlayers of the photographic elements of the invention. Suitable materials are disclosed on page 83 of the November 1976 edition of Research Disclosure, the disclosure of which is hereby incorporated by reference.

Any material is useful as the dye image-receiving layer in this invention, as long as the desired function of mordanting or otherwise fixing the dye images is obtained. The particular material chosen will depend upon the dye to be mordanted. Suitable materials are disclosed on pages 80 through 82 of the November 1976 edition of Research Disclosure, the disclosure of which is hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed on pages 22 and 23 of July 1974 edition of Research Disclosure, and pages 35 through 37 of the July 1975 edition of Research Disclosure, the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the Research Disclosure articles mentioned in the paragraph above concerning neutralizing layers.

The alkaline processing composition employed in this invention is the conventional aqueous solution of an alkaline material, e.g. alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of Research Disclosure, the disclosure of which is hereby incorporated by reference.

The alkaline solution permeable, substantially opaque, light-reflective layer employed in certain embodiments of photographic film units used in this invention is described more fully in the November, 1976 edition of Research Disclosure, page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of Research Disclosure, the disclosure of which is hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" is intended to mean that the materials can be in either the same or different layers, so long as the materials are accessible to one another.

The following examples are provided as illustrations of the invention.

EXAMPLE I

Integral imaging-receiver (IIR) elements were prepared by coating the following layers, in the order recited, on a transparent poly(ethylene terephthalate) film support. Quantities are parenthetically given in grams per square meter unless otherwise stated:

(1) Image-receiving layer of poly(styrene-co-N-benzyl-N,N-dimethyl-N-vinylbenzylammonium chloride-co-divinylbenzene) (49.5:49.5:1) (3.2), gelatin (3.2);
(2) Gelatin layer (0.54);
(3) Stripping layer as described in Table 2 below;
(4) Cyan dye-providing layer of gelatin (0.44) and cyan RDR A (0.32) dispersed in N-n-butylacetanilide, RDR/solvent ratio 1:2;
(5) Interlayer of gelatin (0.54);
(6) Red-sensitive, direct-positive silver bromide emulsion (1.1 silver), gelatin (1.2), Nucleating Agent A (45 mg/Ag mole), 2-(2-octadecyl)-5-sulfohydroquinone potassium salt (0.14), Nucleating Agent B (1.6 mg/Ag mole) and titanium dioxide (0.81);
(7) Interlayer of gelatin (1.2) and 2,5-di-sec-dodecylhydroquinone (1.2);
(8) Magenta dye-providing layer of magenta RDR B (0.43) dispersed in diethyllauramide, RDR/solvent ratio 1:2 and gelatin (0.65); (9) Interlayer of gelatin (0.65);
(10) Green-sensitive, direct positive silver bromide emulsion (0.92 silver), gelatin (0.76), Nucleating Agent A (11.0 mg/Ag mole), Nucleating Agent C (1.2 mg/Ag mole), 2-(2-octadecyl)-5-sulfohydroquinone potassium salt (0.034) and titanium dioxide (0.22);

(11) Interlayer of green-sensitive, negative silver bromide emulsion (0.05 silver), gelatin (1.5) and 2,5-di-sec-dodecylhydroquinone (1.2);

(12) Yellow dye-providing layer of yellow RDR C (0.32) dispersed in di-n-butyl phthalate, RDR/solvent ratio 1.2, yellow RDR D (0.24) dispersed in di-n-butyl phthalate. RDR solvent ratio 1:2, gelatin (1.2) and bis(vinylsulfonyl)methane hardener (0.006);

(13) Blue-sensitive, direct-positive silver bromide emulsion (0.92 silver), gelatin (0.91), Nucleating Agent A (31 mg./Ag mole), Nucleating Agent C (1.1 mg/Ag mole), 2-(2-octadecyl)-5-sulfohydroquinone potassium salt (0.034), t-butylhydroquinone monoacetate (0.016) and titanium dioxide (0.27); and

(14) Overcoat layer of gelatin (0.89) and 2,5-di-sec-dodecylhydroquinone (0.10).

The direct-positive emulsions are approximately 0.8 μm monodispersed, octahedral, internal image silver bromide emulsions as described in U.S. Pat. No. 3,923,513.

Cyan RDR A

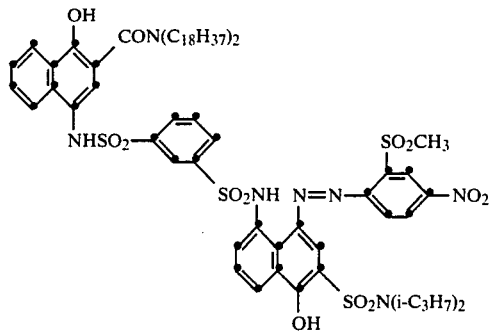

Magenta RDR B

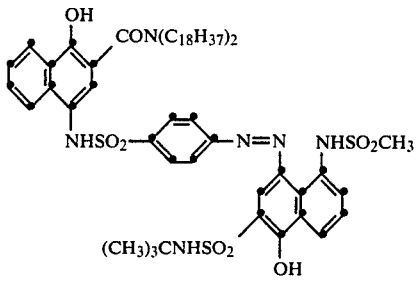

Yellow RDR C

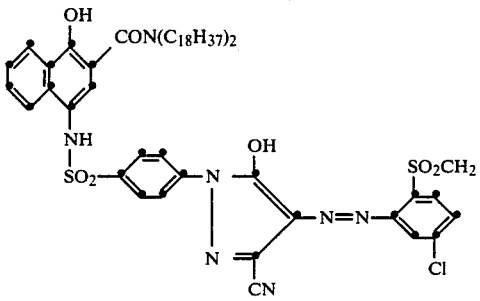

Yellow RDR D

-continued

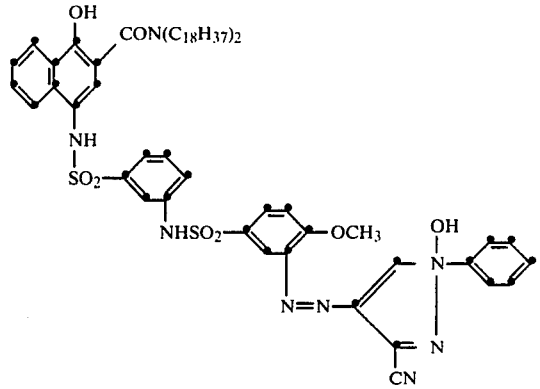

Nucleating Agent A

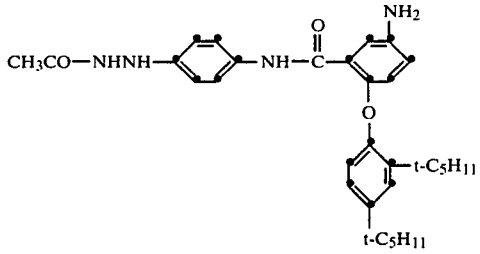

Nucleating Agent B

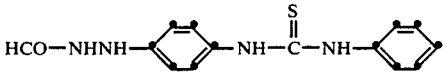

Nucleating Agent C

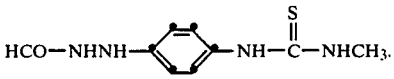

Two of the IIR elements (Nos. 1 and 2) were controls and utilized a commercially available poly(ethylene glycol) (PEG) compound having a molecular weight of 6000 (sold by the Union Carbide Corporation under the tradename Carbowax 6000) as stripping agents. IIR No. 3 utilized a poly(ethylene oxide) compound of this invention as the stripping layer. This PEO is available under the tradename Polyox WSR-301, and is identified in Table I, above.

Dry adhesion stripping performance of each of these IIR's was determined. To avoid the tendency of the layer to peel depending upon the way the separation was started a "tape test" was used. A small area (approximately 2.5×5 cm) of a transparent tape (such as 3M Highland ®6200 Permanent Mending Tape) was pressed to the top gelatin overcoat layer of the IIR leaving enough area free to serve as a handle for pulling the tape. Ideally, a clean separation will occur at the stripping layer. These results were evaluated by visual inspection and were classified as poor or excellent. "Excellent" indicates clean separation at the stripping layer and "poor" indicates either unsightly portions of RDR/gelatin layer (4) adhering to stripping layer (3) or failure to strip.

TABLE 2

| IIR | Stripping Layer | | Dry Strip |
|---|---|---|---|
| No. | Composition | mg/m² | Effectiveness |
| 1 (Control) | PEG, MW 6,000 | 110 | poor |
| 2 (Control) | PEG, MW 6,000 | 540 | poor |
| 3 (Invention) | PEO, MW | 110 | excellent |

TABLE 2-continued

| IIR No. | Stripping Layer Composition | mg/m² | Dry Strip Effectiveness |
|---|---|---|---|
| | 4,000,000 | | |

Wet stripping was also determined for IIR element Nos. 1 and 3 by use of cover sheets comprising the following layers coated, in the order recited, on a transparent poly(ethylene terephthalate) film support:

(1) an acid layer comprising poly(n-butylacrylate-co-acrylic acid) (30:70 weight ratio equivalent to 140 meq. acid/m²);

(2) a layer comprising gelatin (3.8 g/m²) and bis(vinylsulfonyl)methane hardener (0.038 g/m²); and (3) a timing layer comprising 5.4 g/m² of a 1:1 physical mixture by weight of poly(acrylonitrile-co-vinylidene chloride-co-acrylic acid latex) (weight ratio of 14/80/6) and a carboxy ester lactone formed by cyclization of a vinyl acetate-maleic anhydride copolymer in the presence of 1-butanol to produce a partial butyl ester, ratio of acid:ester of 15:85.

A pod containing the following composition was prepared:

| | |
|---|---|
| Potassium hydroxide | 56 g/l |
| 4-Methyl-4-hydroxymethyl-1-p-tolyl-3-pyrazolidinone | 12 g/l |
| 5-Methylbenzotriazole | 10 g/l |
| Carboxymethylcellulose | 42 g/l |
| 11-Aminoundecanoic acid | 3 g/l |
| 1,4-Cyclohexanedimethanol | 8 g/l |
| Tamol ® SN dispersant | 6 g/l |
| Carbon | 192 g/l |

Each IIR element was laminated to a cover sheet by spreading the pod contents at room temperature using a pair of 100 μm gap undercut rollers. After 12 minutes, the laminated unit was separated as described above. The extent of area of emulsion removed was evaluated visually to determine the effectiveness of "wet-stripping". Desirably, all of layers 14 to 3 should be removed using the tape test (dry-stripping) or be removed with the cover sheet (wet-stripping) and should separate cleanly from mordant receiver layers 1 and 2. Thus "excellent" stripping effectiveness represents 100% separation, whereas "poor" stripping effectiveness means layer 3 either did not strip or was partially retained with the mordant receiver layers 1 and 2.

The results of the wet stripping tests are shown in Table 3:

TABLE 3

| IIR No. | Stripping Layer Composition (110 mg/m2) | Wet Strip Effectiveness |
|---|---|---|
| 1 (Control) | PEG (MW 6,000) | poor |
| 3 (Invention) | PEO (MW 4,000,000) | excellent |

EXAMPLE 2

Integral imaging-receiver (IIR) elements (A to C) were prepared by coating the following layers, in the order recited, on a transparent poly(ethylene terephthalate) film support. Quantities are parenthetically given in grams per square meter unless otherwise indicated:

(1) Image-receiving layer of poly(styrene-co-N-benzyl-N,N-dimethyl-N-vinylbenzylammonium chloride-co-divinylbenzene) (mole ratio 49/49/2) (1.1) and gelatin (1.2);

(2) Image-receiving layer of poly(styrene-co-1-vinylimidazole-co-3-benzyl-1-vinylimidazolium chloride) (50:40:10 mole ratio) (1.6) and gelatin (0.75);

(3) Reflecting layer of titanium dioxide (17) and gelatin (2.6);

(4) Opaque layer of carbon black (0.95) and gelatin (0.65);

(5) Gelatin interlayer (0.54);

(6) Stripping layer of poly(ethylene oxide) compound as defined in TABLE 4 (0.11);

(7) Opaque layer of carbon black (0.95) and gelatin (0.65);

(8) Cyan RDR A (as described above in Example 1) (0.37) and gelatin (0.54); and (9) Gelatin overcoat (0.43).

Peel forces required to separate layers 1 to 5 were measured using an Instron Tensil Testing Machine, Model TM-1101 (Instron Engineering Corp., Canton, Ma). The peel forces are recorded below in Table 4.

TABLE 4

| Element | MW of PEO in Stripping Layer 6 | Peel Force, (g/cm) |
|---|---|---|
| A | 600,000 | 25 |
| B | 900,000 | 32 |
| C | 3,500,000 | 15 |

Poly(ethylene oxide) compounds having molecular weights below about 200,000 form adhesive bonds which are too strong to permit clean separation of the processing layers from the receiving layers. Peel forces in the 10–50 g/cm range are indicative of useful performance. The peel force value of 15, for the poly(ethylene oxide) compound having a molecular weight of about 3,500,000, represents a highly desirable stripping result.

The invention has been described in detail with particular reference to preferred embodiments thereof, but it will be understood that variations and modifications can be effected within the spirit and scope of the invention.

What is claimed is:

1. A photographic product comprising (a) A photographic element comprising a support having thereon at least one photosensitive silver halide emulsion layer;

(b) an image-receiving layer; and (c) a stripping layer located between said photosensitive element and said image-receiving layer, wherein said stripping layer comprises a nonionic poly(ethylene oxide) homopolymeric compound having a weight average molecular weight of from about 200,000 to about 5,000,000 present in such concentration that said image-receiving layer can be cleanly separated, after processing, from the remaining layers of said product.

2. The product of claim 1 which also contains an alkaline processing composition and means containing same for discharge within said product.

3. The product of claim 1 wherein said image-receiving layer comprises silver precipitating nuclei.

4. The product of claim 2 wherein said silver halide emulsion layer has associated therewith a dye image-providing material.

5. The product of claim 4 wherein said poly(ethylene oxide) compound is present at a concentration of from about 25 to about 1,000 mg/m² of stripping layer.

6. The product of claim 5 wherein said poly(ethylene oxide) compound is present at a concentration of from about 75 to about 300 mg/m$^2$ of stripping layer.

7. The product of claim 1 wherein said poly(ethylene oxide) compound has a weight average molecular weight between about 200,000 and about 4,000,000.

8. A process for producing a photographic image with the product of claim 1 comprising:

(I) exposing said photographic product;

(II) treating said product with an alkaline processing composition in the presence of a silver halide developing agent to effect development of each exposed silver halide emulsion layer, whereby:

(a) an imagewise distribution of image-providing material is formed as a function of development of said silver halide emulsion layer; and (b) at least a portion of said imagewise distribution of said image-providing material diffuses to said image-receiving layer; and (III) separating said image-receiving layer from the remainder of said photographic product whereby said image-receiving layer will have substantially none of the remaining layers of said product adhering thereto.

9. The process of claim 8 wherein said poly(ethylene oxide) compound is present at a concentration of from about 25 to about 1,000 mg/m$^2$ of stripping layer.

10. The process of claim 8 wherein said silver halide emulsion layer has associated therewith a dye image-providing material.

11. The product of claim 1 which is an assemblage which comprises:

(a) a photosensitive element comprising a support having thereon at least one silver halide emulsion layer having associated therewith a dye image-providing material;

(b) a transparent cover sheet located over the layer outermost from the support of the said photosensitive element;

(c) a dye image-receiving layer located either in the photosensitive element or on said transparent cover sheet; and (d) an alkaline processing composition and means containing same for discharge between said photosensitive element and said transparent cover sheet.

* * * * *